US005154308A

United States Patent [19]

Larson

[11] Patent Number: 5,154,308

[45] Date of Patent: Oct. 13, 1992

[54] DETACHABLE COVER AND DRUM LINER FOR STORAGE AND TRANSPORT OF CONTROLLED MATERIALS

[75] Inventor: Douglas A. Larson, River Forest, Ill.

[73] Assignee: Safety-Kleen Corporation, Elgin, Ill.

[21] Appl. No.: 732,620

[22] Filed: Jul. 19, 1991

[51] Int. Cl.[5] ..... B65D 25/16

[52] U.S. Cl. ..... 220/403; 220/404; 220/465

[58] Field of Search ..... 220/403, 404, 461, 465, 220/601, 627

[56] References Cited

U.S. PATENT DOCUMENTS

| | | | |
|---|---|---|---|
| 2,338,604 | 1/1944 | Silveyra | 220/404 |
| 2,987,216 | 6/1961 | Fletcher | 220/404 |
| 3,167,210 | 1/1965 | Carney, Jr. | 220/404 |
| 3,443,735 | 5/1969 | Meijers | 220/461 |
| 3,698,595 | 10/1972 | Gortz et al. | 220/461 |
| 3,918,605 | 11/1975 | Butler | 220/465 |
| 4,635,814 | 1/1987 | Jones | 220/403 |

*Primary Examiner*—Stephen Marcus
*Assistant Examiner*—S. Castellano
*Attorney, Agent, or Firm*—James T. FitzGibbon

[57] ABSTRACT

A storage and transport drum including a removable cover and a liner bag assembly. The liner bag includes bottom, side, and top walls and a collar surrounding an opening in the top wall. The collar includes a groove for receiving a retainer ring that fits within a groove in the side wall of a drum cover fitting. An exterior plug is provided for the drum cover fitting and an interior plug for the bag collar. The fitting, the collar, and the retainer ring are arranged such that the retainer ring retains the collar against unintentional separation relative to the fitting, but the bag and collar may be intentionally separated by pushing the bag into the drum when desired.

14 Claims, 6 Drawing Sheets

24
25
18
12

120
20
114
96
80
22
18
12

120
124
122
126
128
130
132
134
136
"S
12

FIG. 11
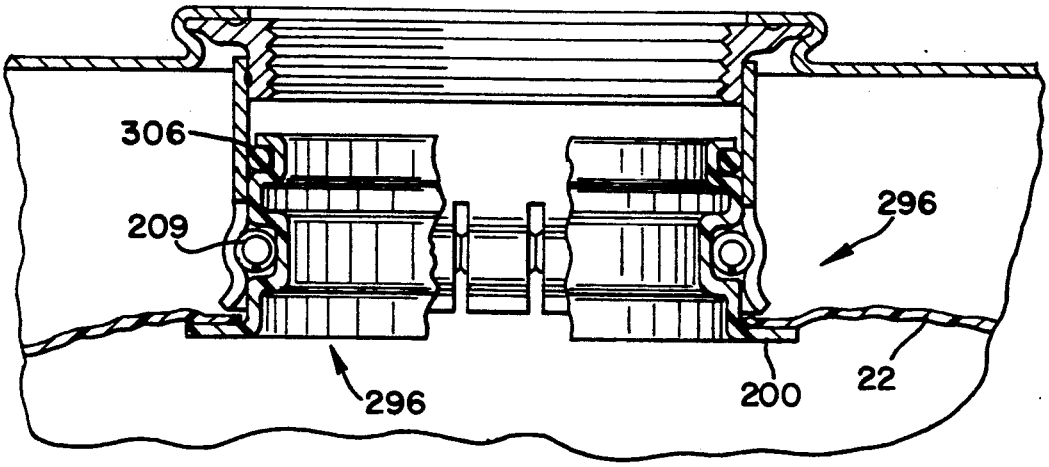
FIG. 12
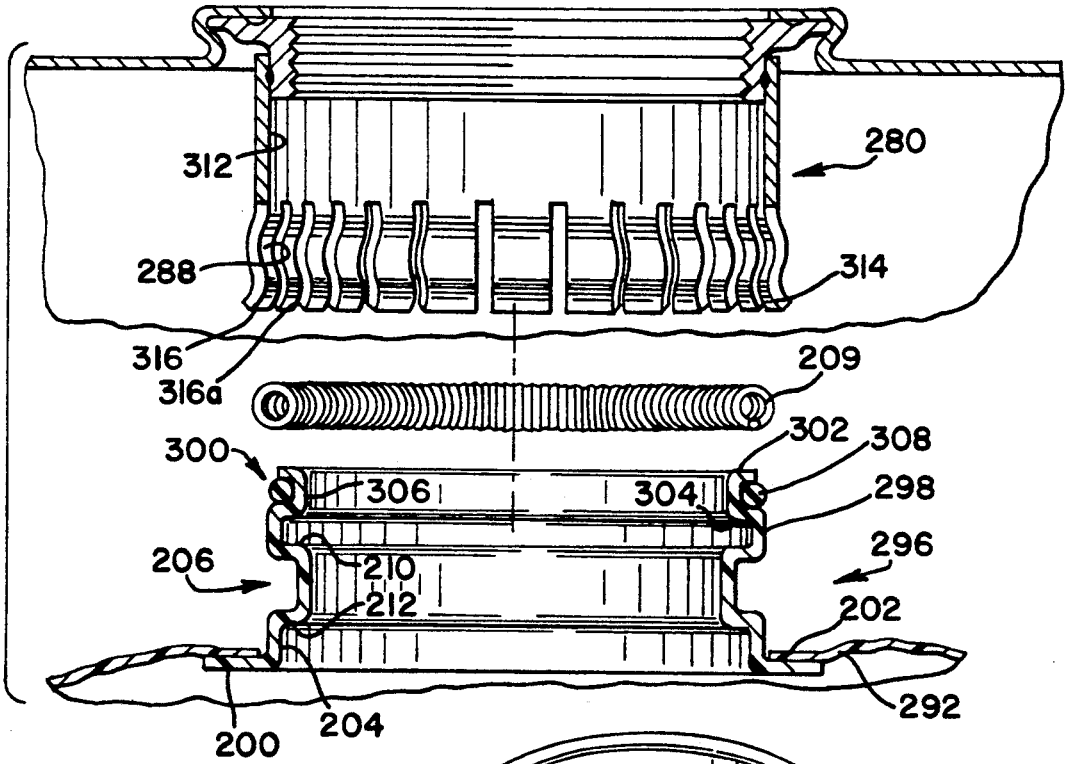
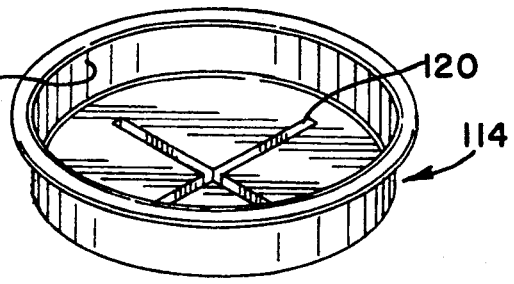
FIG.13

DETACHABLE COVER AND DRUM LINER FOR STORAGE AND TRANSPORT OF CONTROLLED MATERIALS

The present invention relates generally to specialized containers and components thereof. More particularly, the present invention relates to specialty containers for storing, transporting and disposing of hazardous waste.

In one version described in detail, the concept is embodied in what may be termed an "externally detachable drum liner" that is fully self-contained and sealed relative to the drum and cover which encase the liner.

By "hazardous waste" is meant not only materials which, by law or regulation, are considered hazardous to persons or to the environment, but also in a more general sense to all those liquid, granular, or semi-solid waste materials which can create disposal problems. In this connection, it is common for users of such materials to acquire a substantial volume of used liquid, semi-solid or granular, pourable waste materials regarding what direct disposal is a problem.

In order to comply with laws and regulations applicable to the industry in question, such materials, although used, must be contained in storage to await recycling or other appropriate disposition. In other words, since direct disposal of the materials is forbidden, is unwise, or could create adverse environmental effects, the materials must be transiently stored until they are removed to a disposal site. Assuming that waste materials are hazardous or contaminated, as long as the materials can be destroyed by an acceptable method, such as incineration, or may be reclaimed by so-called recycling, the problem of their disposition may be solved.

Whether or not the materials themselves are to be reused, recycled, or disposed of, either wholly or in part, a whole additional set of problems arises in connection with the containers of such materials. By way of example, some materials, over time, settle to the bottom of their containers, and in some cases, adhere more or less strongly thereto. In some cases, materials react with one another inside the storage or transport container. Removing solid or viscous materials, especially those that are strongly adherent to the interior of the container, thus presents a difficult problem for both the container supplier and the material supplier. Where materials are in fact hazardous or toxic, however, even the small amounts of such material remaining within the collection system, i.e., the drum or pail in which they are received, create their own disposal problems. In such a case, therefore, the container itself becomes a source of actual or potential environmental contamination.

To avoid the drawbacks of drum contamination, it has therefore been proposed to develop a system wherein a drum liner is used. According to this concept, the inner surfaces of the drum may be protected from direct contact with the contents. While this is advantageous in a proper case, it presents certain additional problems which are overcome by the instant invention. One such problem is that of lining a drum where the liner terminates on or near the chime of the barrel or drum. In this case, a liquid tight seal must be provided between the chime of the drum and the upper margin of the bag or liner. In a typical case, the bag is simply folded over the chime or upper rim of the barrel and the removable cover is placed thereover. In such an instance, the interior surface of the drum head or cover is exposed to the liquid. The sealing of the contents within the container is a function of the effectiveness of the seal between the drum liner and the rim and cover, with the liner being sandwiched therebetween. While this approach is theoretically acceptable, wrinkles and irregularities in a portion of the drum liner compromise the sealing effectiveness.

Furthermore, the drum liner material is subject to a pinching action. Rough or sharp edges or discontinuities in pressure points, whether arising from dense chips or the like, tend to compromise the seal.

In addition, the exposure of the inner drum surface to the liquid contents creates a similar although somewhat less intense problem of drum contamination. Because a drum made in this way is normally returned to a source with its associated cover, then cross-contamination between the cover and the remainder of the drum can occur after the liner has been removed. Even if this does not occur, there is a requirement for cleaning the interior of the drum head. In those instances wherein a cover sheet has been used in an attempt to protect the inner surface of the drum head, this has generally compounded the problem of rim sealing by adding yet another layer to materials which are already susceptible of wrinkling or pinching the liner, especially in the rim or chime area. These problems remain if a bag or liner is attempted to be passed through an access opening in the drum cover.

In addition, where the contents of the drum are removed from a liner by means of a pump extending through an opening in the drum cover, it is common for the liner to "float" away from the bottom and side walls of the drum and be drawn into a closely surrounding position to the pump stem. This reduces the effectiveness of the pumping or withdrawing action, and in some cases can effectively limit the amount of contents which can be removed from the bag or liner.

It has been proposed to completely line the inside of a drum with a bag-like liner, but this approach has also created significant problems. One problem is that of registering a complete liner with the opening in a bag or bag-type or -like liner with the opening in the drum cover.

A second problem has been lining a so-called closed head drum. Inasmuch as the requirement for controlling hazardous waste extends to the wastes themselves and the materials with which they come in substantial contact, it would be desirable to provide a drum with a detachable liner which would remain in position within the interior of a drum and ensure against leakage of the contents into the drum interior. It would likewise be desirable to provide such a system wherein, after use, the liner, being the only portion exposed to the waste material, could be plugged or sealed after being emptied and thereafter be separated from the drum, preferably by forces supplied from the exterior of the drum. With such a concept, the interior of the container would never be exposed to the hazardous material, exposure to which would be confined to a readily positionable and removable liner.

It would be further desirable to arrange an externally detachable drum liner in such a way that, as a practical matter, the contents of both the drum and the liner could be inventoried and tracked individually, for accurate assessment of storage and disposal, even where the liner and the drum were separated during and after use, and followed different paths thereafter, some of which might include destroying the liner in an environmentally acceptable way on the one hand, and returning the drum to an original or alternate user for reuse, on the other hand.

A key element in such a system would be an arrangement whereby a drum liner would be secured and protected in use and which would be adaptable to existing drum closure designs. In this connection, the advantage of using existing drums with a liner is that the exterior drum, if made from a structurally rugged material such as metal or plastic, can afford the mechanical protection for the contents required by industrial codes, shipping regulations and the like. Hence, using such an arrangement would be doubly advantageous.

In view of the failure of the prior art to provide a relatively foolproof drum liner system for open top containers, it is a object of the present invention to provide a detachable and drum liner for the storage and transport of controlled materials.

Another object of the invention is to provide a drum liner arrangement which is capable of use with existing designs of drums and similar containers, particularly those incorporating a center, plug-receiving fitting of standard design.

It is also an object of the present invention to provide an improved container for waste substances.

Another object of the invention is to provide a novel drum, drum cover and drum liner adapted to be produced at low cost and to simplify disposal of waste contained in the liner, as well as to simplify handling of the drum and cover.

A further object is to provide a combination drum cover and liner unit which serves to contain recyclable material during storage transport and disposition, and wherein the liner remains fixed in use relative to the cover but may be intentionally separated from the cover from the exterior of the drum when desired by the user.

Another object of the invention is to provide a drum liner system adapted to reduce contamination of drums by substances which are or may become hazardous.

Another object of the invention is to provide a combination drum cover and bag liner wherein the liner bag is removably affixed to the drum cover by a simple but effective support system.

A still further object of the invention is to provide a drum cover and liner bag assembly for an associated drum wherein a plug fitting in the drum cover is modified to provide a support unit for a collar forming a part of a bag liner for the drum.

Yet another further object of the invention is to provide a combination drum cover and liner bag wherein the drum cover includes a plug-receiving fitting and means for securing the fitting to the drum cover in liquid-tight relation and wherein the fitting further includes a downward extension having a guiding or alignment portion and a support groove portion, and wherein the bag includes a collar with a center opening and a neck portion for positioning a combination retainer and a seal which may be removably positioned in the groove so as to support the liner bag collar.

Another object of the invention is to provide a drum plug fitting which includes a bag support unit, a liner bag having a collar with a liquid-tight plug removably disposed therein, and wherein the plug fitting has an extension with at least one positioning groove for a retainer ring for removably positioning the line bag collar within a part of the extension.

A further object of the invention is to provide a drum, drum cover and liner bag arrangement wherein the liner bag may be expanded into contact with the walls of an associated drum and cover as air is exhausted between the exterior of the bag and the drum and cover interior.

A further object of the invention is to provide a method of transiently positioning a liner bag within a drum by removably positioning it relative to the drum cover, whereby, after use of the liner bag contents, the liner bag may be separated from the drum and cover so that the contaminated liner bag and the uncontaminated drum and cover may be separately cleaned and/or recycled in a controlled, non-hazardous manner.

A still further object of the invention is to provide a method of modifying existing drum head fittings and drum heads so as to render them compatible with a removable liner bag system for use in the drum with which the cover is associated in use. Yet another object is to provide a liner bag with a collar that includes a retainer ring locates and supports the liner bag relative to plug-receiving fitting on the drum cover, and also serves to provide a seal against leakage from the liner bag to the drum interior.

The foregoing and other objects and advantages of the invention are achieved in practice by providing a drum, a drum cover and bag liner, with the drum cover having a plug fitting and with the cover further including a tubular support unit configured and arranged for removably receiving on its interior surfaces a portion of a collar forming the access opening to the liner bag.

The manner in which the foregoing and other objects and advantages of the invention are achieved in practice will become more clearly apparent when reference is made to the following detailed description of the preferred embodiments of the invention set forth by way of example, and shown in the accompanying drawings, wherein which like reference numbers indicate corresponding parts throughout.

BRIEF DESCRIPTION OF THE DRAWINGS

FIG. 11 is a fragmentary vertical sectional view of a modified form of bag support unit and bag collar made according to the invention;

FIG. 12 is an exploded sectional view of the modified form of bag support unit and bag collar shown in FIG. 11; and FIG. 13 is a perspective view of the plug for the liner bag of the invention.

DESCRIPTION OF THE PREFERRED EMBODIMENTS OF THE INVENTION

While the present invention is capable of a wide variety of uses and may be embodied in several different forms, it is advantageously employed in connection with large metal storage and transport drums, such as those of the 30 gallon and 55 gallon variety. Such steel drums customarily include a body, a continuous sidewall and a bottom unit, permanently seamed to the lower margin of the drum body. In what is termed an "open head drum system", the drum head or cover is a unit which contains a peripheral curl adapted for registration and snug engagement with the top curl or chime of the drum. When so positioned, it is secured by an encircling clamp. The clamp or locking ring contains an over-center locking lever device (or a threaded fastener system) serving to secure the clamp into a tight position of engagement over both the drum chime and the outer margin of the drum cover unit.

According to the present invention, a novel drum cover arrangement is provided which combines a drum liner bag and a bag retainer system adapting the liner bag for removal from the drum cover, only when desired by the user. A drum plug system of a conventional type, but modified for use with the invention, is used. The drum plug closes off an opening through which the contents of the liner bag can be emptied by a pump, a pour spout or the like, once the inner or liner bag plug has been removed.

Inasmuch as many of the liquids which are advantageously stored, transported and emptied according to the invention are recyclable solvents, the contents of the drum are sometimes herein referred to as solvents. Such reference should be taken in a non-limiting sense, however, it being understood that the invention is not limited to use with any particular material, or even with hazardous materials per se. Its primary application is for use with such materials, but their presence is not necessary to the practice of the invention, which is advantageous wherever it is desirable for any reason to avoid contact between a given material and an exterior, rigid container with which it is protectively associated for shipping or storage.

Figure 1:
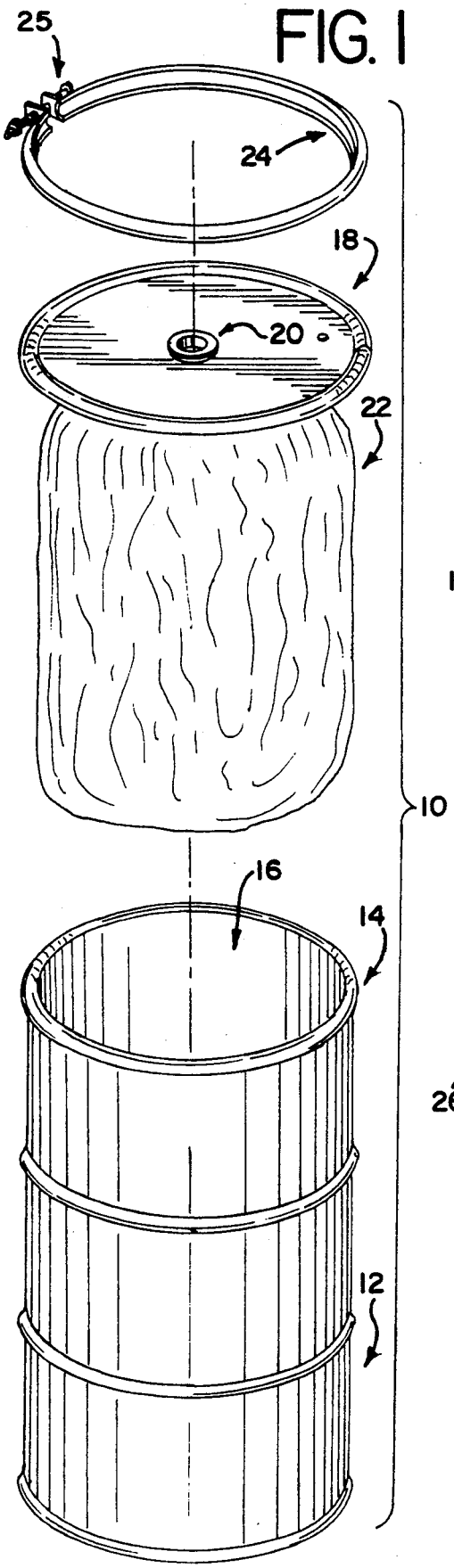
FIG. 1 is an exploded perspective view of the drum, drum liner, and cover of the invention, showing the drum liner secured to the drum cover and also showing the clamp used to affix the drum head to the drum unit.

Referring now to the drawings in greater detail, FIG. 1 shows an improved drum assembly of the invention, generally designated 10, with such assembly 10 being shown to include a drum unit generally designated 12 having a top chime portion generally designated 14 and serving to define the top opening generally designated 16 in the drum unit 12. A novel cover unit of the invention, generally designated 18, includes a plug receiving fitting generally designated 20 which serves not only to permit access to the contents of the drum, but serves to removably locate a drum liner bag assembly generally designated 22, in a manner to be explained in detail herein.

FIG. 1 also shows a locking ring, generally designated 24, of conventional construction for securing the drum cover or head 18 in fixed overlying relation to the opening 16 defined by the upper chime 14 of the drum body 12. A screw-type clamp generally designated 25 is shown to be provided for securing the locking ring 24 in a closed position.

Figure 2:
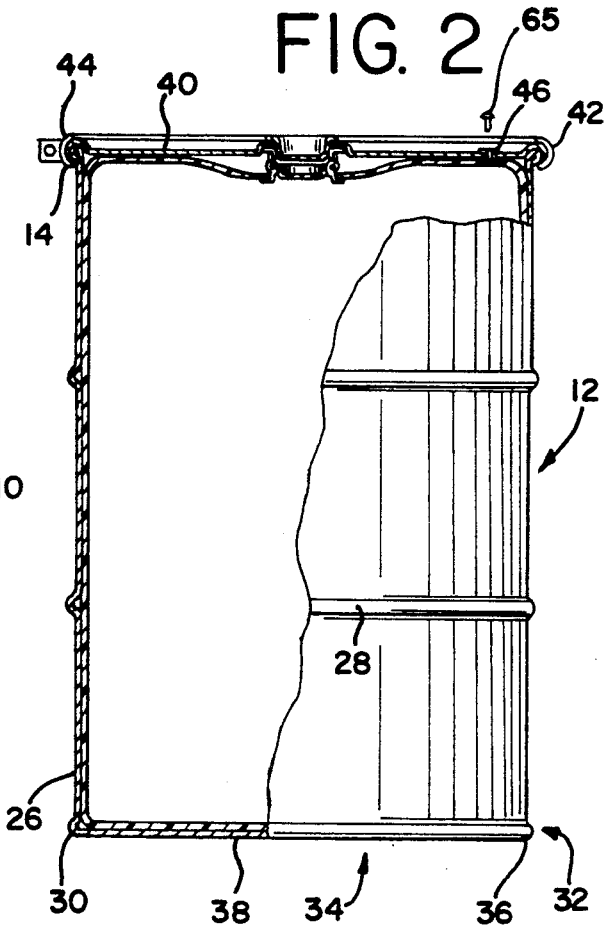
FIG. 2 is a side elevational view, taken partly in section, and showing the drum, drum liner, and drum cover of FIG. 1 in one position of use.

Referring now to FIG. 2, certain additional details of the preferred form of the invention are illustrated. Here, it is shown that the drum 12 includes conventional components such as a continuous imperforate sidewall 26, having plural annular reinforcing or stiffening beads 28 formed therein. The drum sidewall 26 terminates at its upper margin in a curled edge or chime portion 14 and at its lower margin in a curl 30 forming a part of the drum bottom seam generally designated 32. The bottom cover generally designated 34 includes an outer curl 36 and an imperforate center panel 38.

As shown in FIG. 2, the drum head or cover 18 also includes a center panel 40, terminating at its outer periphery in a curled edge ("curl") 42. The contoured wall portions 44 of the locking ring 24 overlie and engage the curl 42 of the drum cover 18. A gasket (not shown) may be positioned within the curl 42 of the drum cover 18 to provide a liquid tight seal between the chime 14 and the cover 18. The center panel 40 of the cover unit 18 preferably includes a vent opening defined by a vent fitting generally designated 46 and lying near an outer margin of the panel 40.

Figure 3:
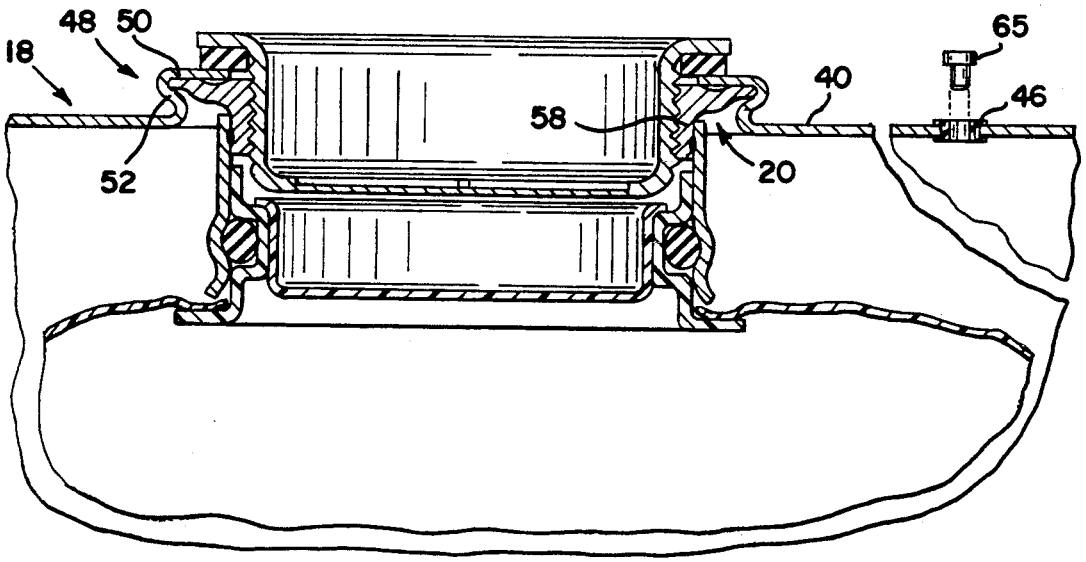
FIG. 3 is a fragmentary view of a portion of the drum cover and drum liner of the invention, taken on an enlarged scale and showing a preferred form of construction with the liner removably secured to an extension on the drum plug fitting received within the drum cover.
Figure 4:
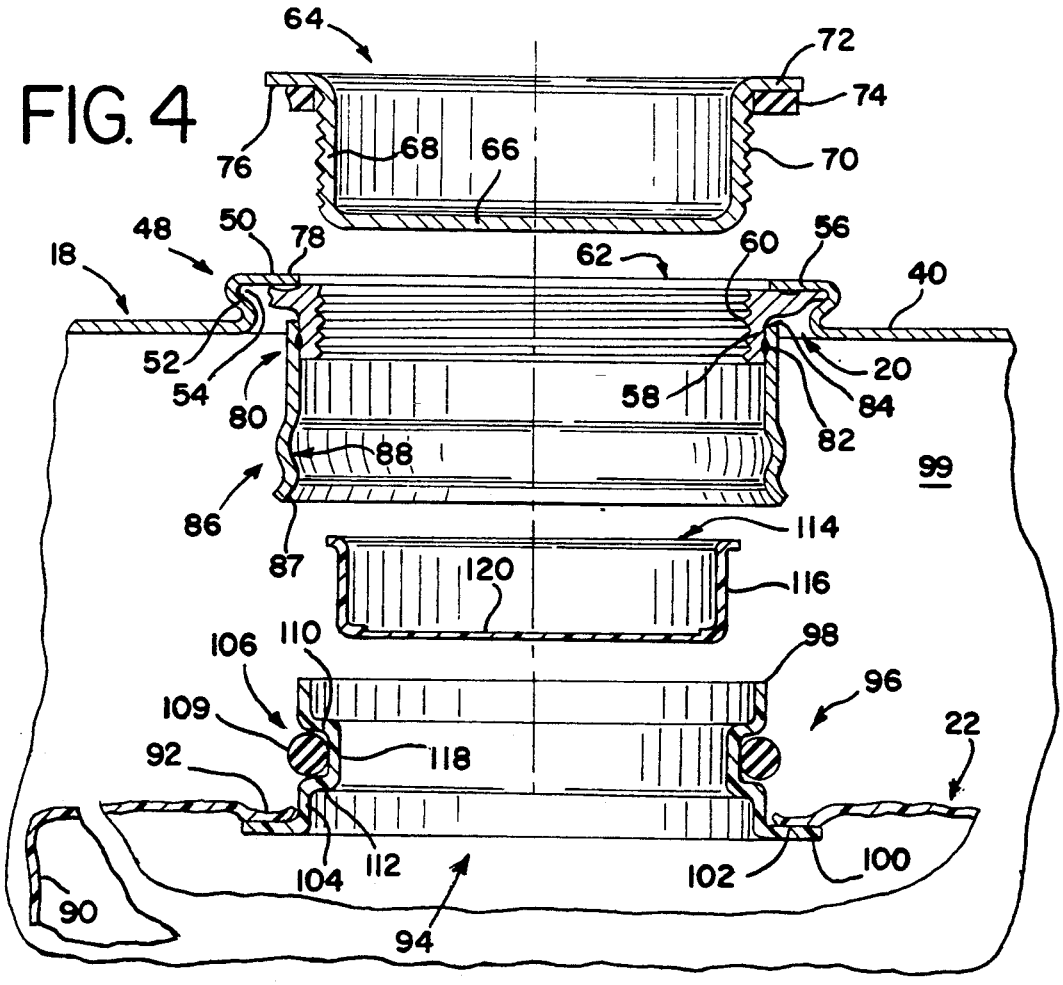
FIG. 4 is a view similar to that of FIG. 3, but showing the elements of FIG. 3 in an exploded relation.

The constructional details of the plug or closure system positioned by the drum cover are best shown in FIGS. 3 and 4. FIGS. 3 and 4 show that the top panel 40 of the drum cover 18 includes an embossment generally designated 48 and shown to include top and bottom folds 50, 52 defining between them a continuous annular groove 54 for receiving the positioning flange 56 (broken away in the left hand portion of FIG. 4) of the plug receiving fitting generally designated 20. The fitting 20, in addition to the positioning flange 56, also includes a cylindrical annular sidewall 58 having threads 60 cut therein and defining a drum cover access opening generally designated 62.

Various constructions of drum covers containing fittings such as those just described are known to those skilled in the art. One such cover, shown in detail herein, is available commercially from the Rieke Corporation of Auburn, Ind. Other suitable fittings, if modified as described herein, may be used.

The drum fitting 20 shown in detail in FIG. 4 is adapted to receive a removable plug generally designated 64 and shown to include a main closure panel 66, a cylindrical sidewall 68 containing external threads 70 adapted to cooperate with the interior threads 60 on the fitting sidewall 58. A peripheral radial flange 72 extends radially outwardly from the upper end of the plug sidewall, and an annular sealing gasket 74 is secured to a lower surface 76 of the flange 72. In use, the gasket 74 is compressed between the surface 76 and a counterpart, upwardly facing surface 78 on the top embossment fold 50 of the drum cover 18.

Various means known to those skilled in the art, including plug inserts or exterior flange configurations (not shown in detail) are used to permit the plug 64 to be screwed tightly into the fitting 20 and to be removed therefrom when and as desired. These include forming the flange 72 in a 6- or 12-point pattern, or spot welding an insert into the plug panel 66, for example.

Referring now to a novel feature of the invention, the plug fitting sidewall 58 is provided with liner bag support means in the form of a sidewall extension generally designated 80 and shown to have its upper cylindrical margin 82 secured in liquid-tight relation, as by welding or the like, to the outwardly facing surface 84 of the fitting sidewall 58.

The lowermost margin generally designated 86 of the extension 80 includes pilot surfaces or like guide means in the form of a taper 87 leading to an annular groove generally designated 88, formed in the lower margin 86 of the extension 80. The groove 88 and the tapered pilot surface 87 serve respectively to align in registry and retain, the collar portion of the drum liner within the extension 80, in a manner to be described.

Figure 10:
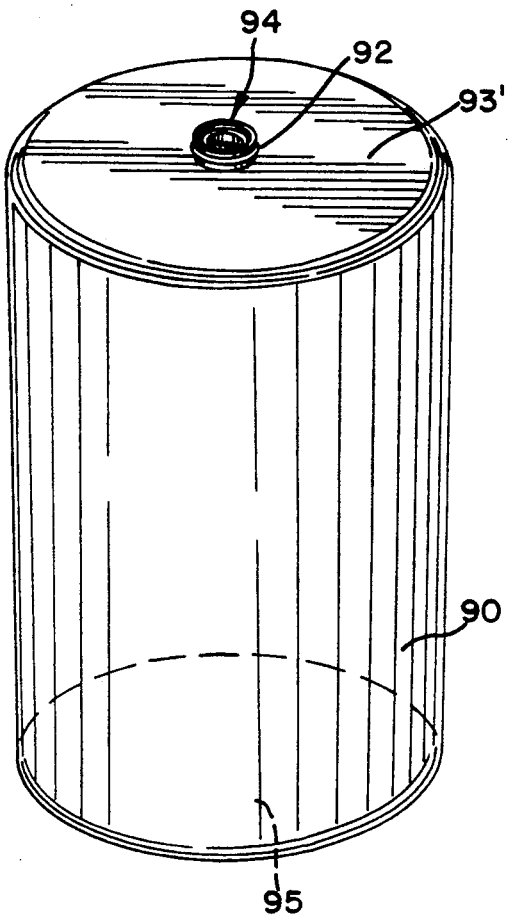
FIG. 10 is a perspective view of the preferred construction of a liner bag made according to the invention.

Referring again to FIGS. 3 and 4, and also to FIG. 10 it will be noted that the liner bag generally designated 22 is shown to include a principal sidewall surface 90 terminating in an upper margin 92 defining a center opening generally designated 94 in the bag. By reference to FIGS. 1 and 10, for example, it will be understood that the sidewall 90 and the top wall 93 of the bag 22 are continuous and imperforate except for the single opening 94 formed therein.

Referring now to the bag positioning collar of the invention, this unit is generally designated 96 in FIGS. 3 and 4 and is of generally annular form. It includes an upper, generally cylindrical neck portion 98, a lowermost radial flange 100, an upper surface of which is secured, as by a heat seal 102 to the margin 92 of the liner bag 22.

A lower, generally cylindrical skirt portion 104 of the collar 96 is separated from the neck 98 by a retainer ring groove generally designated 106. This groove snugly receives retainer means in the form of an elastomeric O-ring 108. The groove 106 has a depth significantly less than the overall radial cross section of the O-ring 108. Consequently, the exterior surface 109 of the O-ring 108 extends radially well beyond the sidewalls 110, 112 of the groove 106. Preferably, the collar 96 is made from a rigid but heat sealable, injection molded thermoplastic material such as high density polyethylene.

FIG. 4 also shows that a bag plug generally designated 114 is provided for snug, fluid-tight sealing of the opening 94 defined by the inner surfaces of the bag collar 96. A cylindrical sidewall 116 is provided on the bag plug 114 for snug but removable engagement with the interior surface 118 of the O-ring groove 106, i.e., the surface opposite the surface engaged the inner diameter of the O-ring 108.

The bag plug 114 is also shown, as in FIG. 13, to include areas of weakness 120 in the form of score lines extending radially outwardly from the center of the plug, preferably arranged in a cross or "X" configuration.

Referring now to additional details of construction, the drum liner bag 22 is preferably made as shown in FIG. 10, i.e., in the form of a continuous cylinder having a circular top panel 93, a sidewall panel 90 and a bottom wall 95, all heat sealed together a the respective panel margins. The diameter and height are such that the bag sidewalls are at least equal to the interior diameter (i.d.) of the drum, and the height of the bag 22 is at least equal to the interior height dimension of the drum, i.e., the distance between the upper surface of the bottom drum panel 38 and the lower surface of the top cover panel 40.

The reason for this is so that, with the bag completely full, structural support for the bag contents is provided by the exterior of the drum. This ensures that no part of the weight of the contents is borne by the bag alone or by the bag collar, regardless of the orientation of the drum. This facilitates compliance with shipping regulations.

Referring now to assembly of the drum and drum cover, and filling of the bag, an empty bag 22 is initially positioned such that its collar 96 is in approximate alignment with the open lower end of the fitting extension 80. At this point, the collar 96 is pressed upwardly into the interior of the extension 80. The neck 98 engages and is centered by the bevel 87, and continual axial movement of the collar 96 continues until the O-ring 108 snaps into the groove 88.

The retainer or O-ring in this embodiment thus provides the dual function of retaining the collar 96 and bag 22 in position relative to the extension 80 and the fitting 20 which it is a part, and also of providing a seal so liquid in the liner bag 22 will not escape into the space 99 (FIG. 3) between the bag 22 and the walls of the drum 12 and/or its cover 18.

In this connection, the outside diameter of the O-ring 108 is such as to have a substantial interference with the inner surface of the locating groove 88 even where the groove 88 reaches its greatest diameter. The arrangement of the tapered or beveled pilot surface 87 is such that the neck portion 98 of the collar 96 will be initially guided into a position of centering or registration relative to the extension 80. As pointed out, when sufficient pressure is applied from beneath the collar 96, the parts mate in a snug, mechanically secure relation.

In this connection, it will be noted that while there is a snug seal between the O-ring 108 and the groove 88 in the extension 80, it is not strictly necessary that these same parts provide the seal, or that a seal, although almost always desired, must be provided. However, a removable mechanical interlock shall be provided according to the invention.

In the preferred form of assembly and filling the drum cover 18 is separated from the drum 12, while the bag 22 is being positioned relative to the drum cover 18. After the bag and cover are registered and assembled, as described above, and before the bag plug 114 is inserted, the bag is placed into the interior of the drum 12. Next, the drum cover 18 is positioned over and in registry with the chimes 14 forming the top of the barrel sidewall, and the locking ring 24 is placed over the chime assembly thus formed and clamped in place.

The vent is opened by removing the plug 65 from the vent fitting 46. Next, the bag is inflated with a low pressure, high flow air source, and air in the space 99 is then exhausted through the vent fitting 46. Once the bag 22 is inflated, and the vent plug 65 is inserted in the fitting 46, the bag walls will maintain their position of close contact with the top, bottom and side walls of the drum.

The bag may then be filled with solvent or the like through the openings in both the fittings, i.e., the openings 62 and 94. After the bag is filled to the desired level, the bag plug 114 is pressed into snug, liquid-tight contact within the collar 96. This fit is snug enough to be liquid-tight but not so tight as to disengage the collar 96 from the collar support 80.

With the bag being filled and capped by the plug 114, the drum is then readied for shipment by insertion of the metal drum plug 64 in the fitting 20.

In this configuration, even if laid on its side or inverted, the drum supports the weight of the bag and its contents and no strains are placed on the bag sidewalls or the collar. Because of the bag dimensions, as pointed out, there are likewise no lateral forces applied to the entire closure system.

Figures 5, 6, 7:
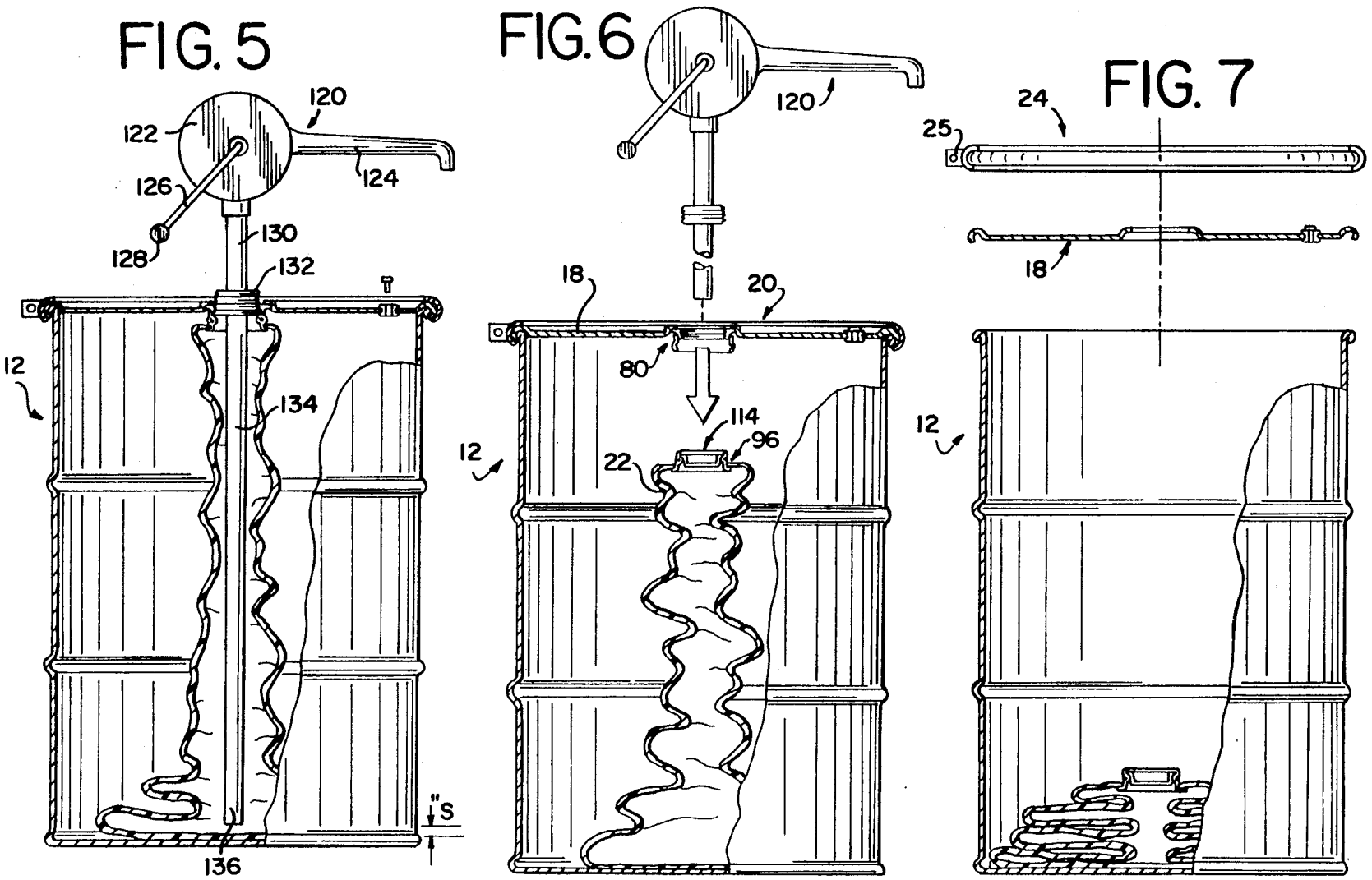
FIG. 5 is an elevational view, with portions shown in section, and partly diagrammatic in character, showing the action of an associated pump for removing the contents of bag liner, including the manner in which the liner bag collapses as it is emptied.
FIG. 6 is an elevational view similar to FIG. 5, showing removal of the pump after use, and initial separation of the liner bag from the drum cover.
FIG. 7 is a sectional view similar to that of FIG. 6 and showing removal of the drum cover and locking ring from the drum after the bag is separated from the cover.

When the container reaches its destination, both the fitting plug 64 and the vent plug 65 are removed. The exposed cap or plug 114 is then also removed from the collar 96 to provide access to the contents of the liner bag 22, and a pump of a suitable type, generally designated 120, is inserted. Such a pump may typically be a hand operated pump for transfer and dispensing liquid as shown in FIGS. 5 and 6, for example. Suitable pumps are of a type known to those skilled in the art, and may be what is known as a Blackmere Model 210/210A pump, for example.

Referring now to FIG. 5, for example, the pump 120 is shown to be conventional and to include a housing 122 for the operative portions of the pump, a spout 124, a rotary crank or arm 126, and an operator handle 128. The pump further includes an upper support stem 130, a locating fitting 132, and a dip tube 134. As shown, an attractive aspect of the present invention is that the lowermost end 136 of the dip tube 34 need not rest upon or be in contact with the bottom panel 95 of the bag liner 22. This reduces the risk of puncturing the bag 22. Another reason for providing a space "S" between the lower end 136 of the tube 134 and the bottom panel 95 of the bag (and the drum bottom panel 38) is described herein.

Referring again to FIG. 5, and bearing in mind that it is presumed that the plug 65 from the vent has been removed from the vent fitting 46, as the pump handle 128 is manipulated, the contents of the liner bag are withdrawn.

With the transfer pump appropriately sealed to the fitting 20 in the drum opening, and with the vent plug 65 removed, continued removal of the liner bag contents causes the bag to collapse around the pump dip tube 134. As the liquid falls below a level at which a standard pump would no longer draw liquid, i.e., with the end of the dip tube above the liquid level, the pump would usually withdraw only air thereafter. However, in the normal use of the invention, the collapsing bag effectively forces most of the residual liquid toward the inlet at the lower end 136 of dip tube 134.

This inventive arrangement therefore, not only allows the pump inlet to be spaced apart from the drum bottom wall to help prevent bag damage, but also prevents the bag from being drawn into the dip tube pump inlet. Evacuating the space 99 between the exterior of the liner bag and the interior of the drum having initially been accomplished by exhaustion of air through the vent opening 46, the return of air into this space 99 and permits the bag to collapse upon and surround the pump stem or inlet for complete contents withdrawal. In drums without a collapsible liner, it is more difficult to completely empty the contents of the drum.

Figure 8:
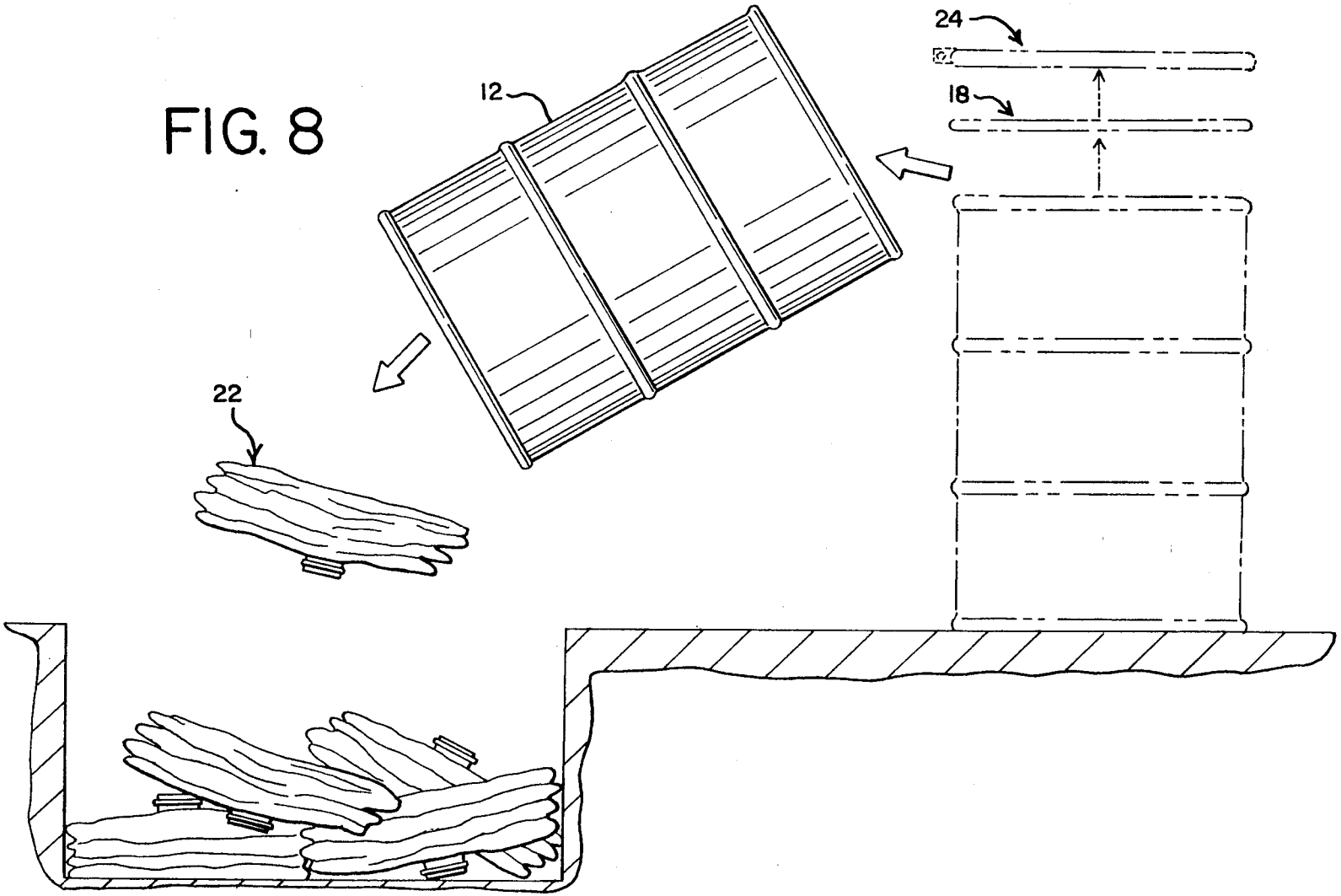
FIG. 8 is an elevational view, somewhat diagrammatic in character and showing storage of an empty bag taken from the drum.

When the bag liner interior contains a residue of solvent or other material, the user then removes the pump (FIG. 6) and replaces and secures the bag plug 114 within the plug opening in the collar 96 while the collar is retained in the support extension 80. Thereupon, an additional strong push on the center panel of the plug 114 will serve to displace the collar 96 from the support extension 80, as shown in FIG. 6. After the clamp ring and lid are removed, as shown in FIG. 7, the sealed bag is ready for removal from the drum. FIG. 8 shows one way of accomplishing this, i.e., by dumping the bag into a storage area "A" where it is consolidated with additional, previously emptied bags. The drum interior is completely free of liquid and does not serve as a hazardous waste generator and does not require careful washing or the like to be put back into service.

Figure 8A:
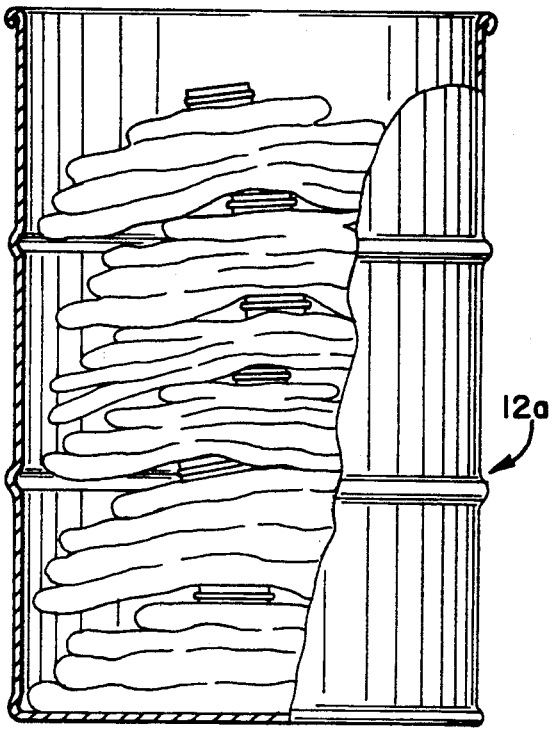
FIG. 8A is a fragmentary sectional view of a drum in which numerous liner bags are being accumulated for storage before disposition.

FIG. 8A shows an alternate scheme wherein plural liner bags 22 are accumulated in a drum dedicated to transient storage. This drum **12*a*** may be used as the vehicle for accumulation and return of the bags to an authorized waste processor.

According to the present invention, the used liner bags are kept sealed after use. They may then be picked up for disposition by an authorized disposal agency. Consequently, the original supplier of the material may maintain records, including those maintainable through the use of a bar code system for example, enabling it to track the whereabouts of its drums, the drum liner, and the contents of the bag. In a typical situation, once an accounting has been made of the bag liner, i.e., that it has reached its initial destination and has been emptied and transferred to a responsible recycler or disposition agency, the material supplier can be exonerated of environmental liability, whether or not the drum itself is returned to him. The drum is attractive to other users because it was not exposed to contaminants, especially those which, during attempted elimination, would in and of themselves become waste generators. This means the drum need not be tracked and/or returned to its original source.

Referring now to alternative embodiments of the invention, one preferred form of liner has been shown in detail, including a preferred form of collar for removably securing the bag relative to the drum cover. Mating an elastomeric O-ring with a counterpart groove formed in a fitting extension is a preferred method of arranging the components, although structural variations may be made without departing from the scope of the invention.

Figure 9:
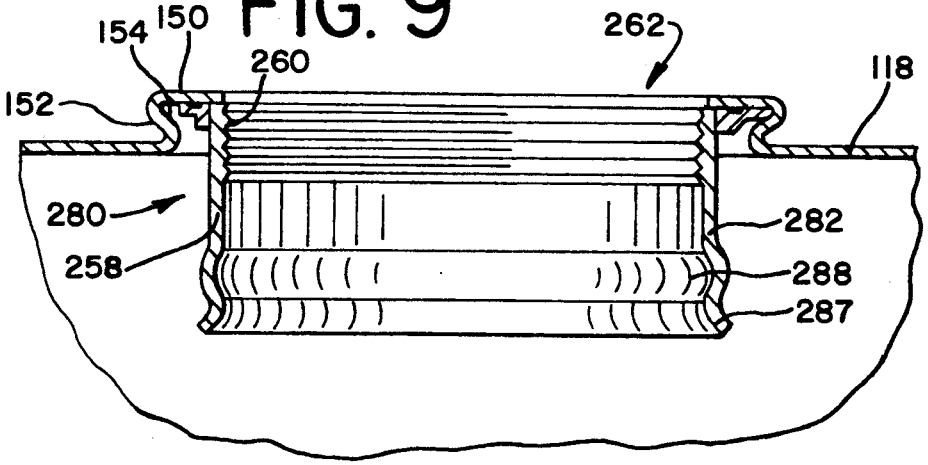
FIG. 9 is a vertical sectional view of a modified form of a combination plug fitting and liner bag support unit of the invention.

One such change is shown in FIG. 9, wherein the liner bag support means and the plug-receiving fittings are made differently than their counterparts shown in FIGS. 3 and 4. As shown in FIG. 9, a plug-receiving fitting generally designated 220 comprises a positioning flange 256 extending outwardly from the body 257 of the fitting 220. The edges of the positioning flange 256 lie within top and bottom folds 250, 252, of the drum cover panel 240, in a groove 254.

In the embodiment shown in FIG. 9, the bag collar support means and the plug-receiving means are made from a single element, generally designated 280 having a cylindrical sidewall 258 with inwardly directed threads 260 formed on its upper portion. The opening generally designated 262 for the drum closure plug (not shown) is defined by the threaded portion of the sidewall 258. The lowermost part of the sidewall includes an intermediate portion 282, lying between the threads and the lower section in which an annular groove 288 is formed. Beneath the annular groove 288 is a tapered pilot surface 287.

In operation, the fitting is identical to that of its counterpart in FIGS. 3 and 4. Manufacture of the embodiment of FIG. 9 may be simplified that in a single piece of tubing may be used to form both the bag support means and the plug-receiving means.

In addition to the forms of closure and bag support system shown in FIGS. 3, 4 and 9, the invention may also be practiced using other drum closure systems. In some of these, the fitting is secured as shown, i.e., by embossing and post-forming portions of the cover. Heat sealing and spin welding are also acceptable in the cases of drums made from suitable materials. Various shapes of gaskets or support systems may be provided, including those of different cross sectional shapes. The disposition of the fitting in the center of the drum cover is not essential, but is preferred for convenience in stirring the contents of the drum, for example.

The invention also comprehends using the liner bag system with drums containing known safeguards such as venting closures, for example. In this connection, the breaking strength of the inner or bag cap is made to be less than that of the venting pressure of the plug, which may be set to a value appropriate for the contents of the drum. Likewise, negative pressure venting may be provided for by suitable selection of plugs.

While it is not strictly essential that the bag support depend from the plug-receiving fitting, that is, it could be affixed directly to the cover, inasmuch as it is desired to align the openings for the liner bag and the drum cover, the use of common, or at least aligned, parts is preferred.

Referring now to FIGS. 11 and 12, another form of bag collar generally designated 296 is shown to be engaged with another form of sidewall extension, this one generally designated 280. In this embodiment, certain constructional details of the extension 280 and the collar 296 differ from their counterparts shown in FIGS. 3 and 4. The main difference regarding the collar is that the support function and the sealing function are separated from each other; regarding the support means or extension, this is also modified to illustrate an optional feature of the invention.

Referring now specifically to the collar 296, in addition to an O-ring groove generally designated 206, and shown to be formed by upper and lower sidewalls 210, 212, a neck portion 298 is shown to be surmounted by an auxiliary, seal ring receiving groove generally designated 300 and shown to be defined by groove sidewalls 302 and 304, and a groove bottom wall 306. An elastomeric seal ring 308 is received therein, having a portion of its radially outer surface adapted to engage the inwardly facing surface 312 of the cylindrical extension 280. In use, a tight liquid seal is provided by dimensioning these parts for a snug fit. The ring 308 is preferably made from a chemically resistant synthetic elastomer and is appropriately resilient so as to provide proper sealing action.

Referring now to the lower portion of the collar unit, in addition to the radial flange 200, at which the inner margin 292 of the bag is affixed as by a heat seal 202, a skirt portion 204 is provided between the flange 200 and the seal ring groove 206. In this instance, in lieu of an elastomeric O-ring, a so-called garter spring 209 is shown to be provided. In this embodiment, the retainer ring is thus a somewhat tightly wound metal coil spring disposed in the groove 206. The annular support groove 288 in the lower portion of the support extension is similar to its counterpart in FIGS. 3 and 4, except that a plurality of axially extending cuts 314, circumferentially spaced about on the wall of the extension 280, create a series of individual, spring fingers 316, 316*a*, etc.

The function of this embodiment is the same as its counterpart in two respects. In the form illustrated in FIGS. 11 and 12, the lower skirt of the bag collar support means or extension 280 comprises plural individual fingers 316, 316*a*, etc. for greater flexibility, while the garter spring 209 is somewhat less resilient. This illustrates that, in providing the support, either or both of the engaged parts may differ in stiffness. As long as the function of removably supporting the bag collar by a retainer ring secured between opposed parts is provided, the unit will function satisfactorily.

Inasmuch as the grooves 288 in the embodiment of FIGS. 11 and 12 are not liquid tight, the sealing function is simply moved upwardly and provided in an area wherein the sidewall is continuous and hence liquid-impermeable. In this area, namely, the area of the groove 300 for the upper O-ring 308, the elastomeric ring 308 provides the necessary liquid seal. It will be appreciated by those skilled in the art that other variations may be made to the form of support and seal illustrated. The simplest form, however, enables these functions to be achieved by a single ring. However, if the order of the forces required to achieve support and sealing differ significantly, a separation of the functions may be desirable.

It will thus be see that the present invention provides a novel drum and drum liner having a number of novel advantages and characteristics, including those referred to specifically herein and others which are inherent in the invention. Several preferred forms of drum and liner having been described in detail, by way of example, it is anticipated that the variations in the described forms of construction may occur to those skilled in the art, and that such variations may be made without departing from the spirit of the invention or the scope of the appended claims.

I claim:

1. An improved storage and transport drum assembly for materials requiring controlled handling and storage, said drum assembly comprising, in combination, a drum body having a bottom wall portion and a sidewall portion with an upper margin having means for receiving and positioning a drum cover in fluid tight relation, and a combination drum cover and liner bag assembly, said drum cover having an outer margin adapted for liquid tight sealing with said receiving and positioning means on said drum body, a main cover panel portion with an access opening formed therein, a plug-receiving fitting disposed in said access opening, said fitting including a positioning flange and an annular cylindrical sidewall with a threaded inner surface defining an opening for removably receiving a drum plug, said positioning flange being secured in liquid-tight relation to said main cover panel portion and with said opening in said fitting being in registry with said access opening and a generally cylindrical support unit for detachably securing a liner bag assembly relative to said drum cover, said support unit having one portion fixed in relation to said fitting sidewall and another portion comprising an annular locating groove, said liner bag assembly including a liner bag sized for reception within said drum body and having bottom, side and top bag walls, an opening in said top wall and a bag collar affixed to said liner bag about said bag opening, said bag collar including at least one bag collar groove, and a retainer ring disposed in said bag collar groove, with said retainer ring, said locating groove and said bag collar groove being sized such that, with said retainer ring positioned at least partially within each of said grooves, said bag collar and said support unit are attached so as to resist unintentional separation during shipment, but to permit separation under a force applied axially to said collar while it is positioned within said support unit.

2. An improved assembly as defined in claim 1 wherein said drum cover further includes a vent fitting and a vent plug removably received therein.

3. An improved assembly as defined in claim 1 wherein said plug-receiving fitting includes a threaded inner surface..

4. An improved assembly as defined in claim 1 wherein said retainer ring is an O-ring.

5. An improved assembly as defined in claim 4 wherein said O-ring is made from an elastomer.

6. An improved assembly as defined in claim 1 wherein said liner bag is made from a polyethylene material.

7. An improved assembly as defined in claim 1 wherein said collar includes a generally cylindrical, plug-receiving surface.

8. An improved assembly as defined in claim 1 wherein said generally cylindrical support unit comprises a member having its upper margin secured to an outer surface of said fitting sidewall in liquid-tight relation.

9. An improved assembly as defined in claim 1 wherein said generally cylindrical support unit further includes a tapered pilot surface forming its lowermost margin.

10. An improved assembly as defined in claim 1 wherein said annular locating groove is an imperforate groove, and wherein said retainer ring comprises an elastomeric ring, whereby said elastomeric ring also serves as a fluid seal between said bag collar and said support unit.

11. An improved assembly as defined in claim 1 wherein said annular locating groove comprises a plurality of spaced apart individual, resilient fingers adapted for engagement of said retainer ring, whereby said collar may be supported by said fingers, said collar further including a seal ring groove spaced axially upwardly of said groove for said retainer ring, and a seal ring disposed in said seal ring groove, said seal ring being sized for snug liquid-tight engagement with an imperforate inner surface of said support unit.

12. In combination, a removable drum cover and a storage and transport bag adapted to serve as a drum liner and to be received within and at least partially supported by a drum with which said drum cover is removably associated in use, said drum cover including a main cover panel, an outer margin including means for engaging a chime of said drum in liquid-tight relation, means defining a principal opening in said main cover panel, a plug-receiving fitting secured in liquid-tight relation to said drum cover adjacent said principal opening, said fitting having means defining a drum plug-receiving opening and also extending below said main panel of said drum cover, and a drum liner unit , said drum liner unit including a bag portion having imperforate side and bottom walls and a top wall with a margin defining a single access opening in said top wall, a collar secured about said margin of said top wall of said bag portion in liquid-tight relation, said collar including a continuous annular sidewall with an annular groove, a flexible retainer ring disposed in said annular groove, and a collar support unit extending beneath the plane of said drum cover and being fixed in relation to said drum cover, said collar support unit including means defining a support groove therein for engaging and supporting said retainer ring, with said retainer ring, said annular groove in said collar, and said collar support unit being sized such that, when said flexible retainer ring has portions engaging both said annular groove in said collar and said support groove in said collar support unit, said collar and said collar support unit are secured to each other by an interference fit so as to resist separation during shipping, handling and contents removal, but to permit separation under a force applied axially to said collar through said plug-receiving opening in said fitting.

13. A combination as defined in claim 12 wherein said retainer ring is an elastomeric O-ring.

14. A combination as defined in claim 12 wherein said collar includes a seal ring in addition to said retainer ring, said seal ring being adapted for snug engagement with a portion of said collar support unit.

* * * * *